US006860672B2

(12) United States Patent
Kim

(10) Patent No.: US 6,860,672 B2
(45) Date of Patent: Mar. 1, 2005

(54) REINFORCING BAR COUPLING

(76) Inventor: Yong-Keun Kim, 5-1405, Hyoseong Sang-a Apt., 905 Mansoo 5 Dong, Namdong-Gu, Incheon (KR), 405-755

( * ) Notice: Subject to any disclaimer, the term of this patent is extended or adjusted under 35 U.S.C. 154(b) by 0 days.

(21) Appl. No.: 10/467,128

(22) PCT Filed: Feb. 7, 2002

(86) PCT No.: PCT/KR02/00190

§ 371 (c)(1),
(2), (4) Date: Aug. 2, 2003

(87) PCT Pub. No.: WO02/064907

PCT Pub. Date: Aug. 22, 2002

(65) Prior Publication Data

US 2004/0071507 A1 Apr. 15, 2004

(30) Foreign Application Priority Data

Feb. 14, 2001 (KR) ..... 2001-7181

(51) Int. Cl.[7] ..... B25G 3/00

(52) U.S. Cl. ..... 403/314; 403/109.5; 403/286; 403/293; 403/300; 403/312; 403/367; 403/374.1; 403/374.2; 403/374.3; 403/374.4; 52/726.1

(58) Field of Search ..... 403/293, 314, 403/367–370, 373, 374.1–374.4, 109.5, 300, 312, 286; 52/726.1, 649.1, 649.7, 679

(56) References Cited

U.S. PATENT DOCUMENTS

| | | | | | |
|---|---|---|---|---|---|
| 62,081 | A | * | 2/1867 | Smith | 403/314 |
| 85,465 | A | * | 12/1868 | McKinney | 403/314 |
| 256,280 | A | * | 4/1882 | Brown | 403/314 |
| 422,720 | A | * | 3/1890 | Capron | 403/314 |
| 3,551,999 | A | * | 1/1971 | Gutmann | 403/300 |
| 4,127,354 | A | * | 11/1978 | Mixon, Jr. | 403/306 |
| 4,408,926 | A | * | 10/1983 | Werner | 403/314 |
| 6,328,499 | B1 | * | 12/2001 | Reding et al. | 403/374.1 |

* cited by examiner

*Primary Examiner*—John R. Cottingham
*Assistant Examiner*—Victor MacArthur
(74) *Attorney, Agent, or Firm*—GWiPS

(57) ABSTRACT

A reinforcing bar coupling is provided for simply and quickly applying to a mechanical butt joint of two bars in the concrete constructions. The reinforcing bar coupling is consisted of a cylindrical sleeve (2) formed an uneven inner surface (22) to mate with the ribs (11) formed around outer surface of the reinforcing bars (1), an intermediate pad (3) having an uneven semi-circular surface at one side and an inclined-declined flat surface at opposite side, a gap provided between the cylindrical sleeve (2) and the intermediate pad (3), and a pair of wedges (4) being inserted into the gap. The inner surface of the cylindrical sleeve (2) and the outer surface of the reinforcing bars (1) are radially compressed to provide the butt joint of the two bars (1) by the wedging action.

12 Claims, 13 Drawing Sheets

REINFORCING BAR COUPLING

BACKGROUND OF THE INVENTION

1. Field of the Invention

The present invention relates, in general, to a coupling and, more particularly, to a reinforcing bar coupling which is intended to obtain a mechanical butt-joint between the ends of two reinforcing bars in reinforced concrete work to enhance the strength of the coupled portion and to afford a prompt and convenient coupling operation.

2. Related Prior Art

Since reinforcing bars are produced at certain unit lengths from factories, building works for various structures such as bridges, retaining walls and apartment houses, which extend to several tens of meters in length, require the ends of reinforcing bars to be overlapped. As conventional methods for joining reinforcing bars, a few joint processes are commonly used, which are disclosed as follows.

In the prior art, a lap-joint process, which is carried out in such a way that the ends of reinforcing bars are lapped along certain lengths thereof and the lapped ends of the reinforcing bars are bound with binding wires, is predominantly used. However, the lap-joint process has disadvantages in that distances between the adjacent reinforcing bars become small at the lapped regions, the required number of reinforcing bars is increased due to the lapped regions of the reinforcing bars, a pouring operation of concrete into space between the lapped reinforcing bars is difficult due to the small distances between the adjacent reinforcing bars, and the lap-jointed reinforcing bars are weakened in resistance to axial tensile force and compressive force.

In another process, i.e., in a gas pressure welding process in which the ends of reinforcing bars are butted to each other and the ends of the reinforcing bars are welded to each other by high temperature flame, a specialized technique is required to carry out the gas pressure welding process, the welded portion of the reinforcing bars is weakened by heat, and a post-welding inspection is further required.

In a steel pipe compression process in which the ends of two reinforcing bars are inserted into a steel pipe and the steel pipe containing the ends of two reinforcing bars is compressed by a hydraulic jack, though a specialized technique is not required, special equipment is required to perform the joining operation.

Therefore, to overcome the above problems, a process for mechanically joining two reinforcing bars has been developed and used in recent years.

In this process, the ends of reinforcing bars are subjected to a plastic deformation, i.e., thickened and shortened by hot or cold working, or the ends of reinforcing bars are subjected to cold swaging, causing the ribs of the bars to be collapsed and to be smooth, and then threaded with external threads (male) by a machine tool such as a screw thread rolling machine. Subsequently, the threaded ends of two reinforcing bars are threaded into a coupling having female threads in its internal surface, thereby joining the two reinforcing bars.

However, the above thread-joint process also has disadvantages in that it requires many working steps to form male threads on the ends of the reinforcing bars, and although reinforcing bars are considerably long and apt to be bent due to the material characteristics thereof, two reinforcing bars must be precisely aligned with each other to allow the ends of the reinforcing bars to be threaded into a coupling, thereby involving inconvenience in the joining operation.

SUMMARY OF THE INVENTION

Accordingly, the present invention has been made keeping in mind the above problems occurring in the prior art, and an object of the present invention is to provide a reinforcing bar coupling which is capable of achieving a firm joining between reinforcing bars by a simple operation of inserting wedges between the reinforcing bars and a cylindrical sleeve and hammering the wedges.

In order to accomplish the above object, the present invention provide a reinforcing bar coupling, comprising: a cylindrical sleeve having a cross sectional area sufficient to accommodate two reinforcing bars entered through openings at opposite ends thereof, and which is provided at a part of its inner surface with an uneven surface corresponding to an outer ribbed surface of the reinforcing bars; and a wedge means adapted to be fitted between the cylindrical sleeve and the reinforcing bars to apply radial force to them, thereby achieving butt-joining of the two reinforcing bars.

Furthermore, the present invention provides a wedge means which is configured to have a length substantially equal to that of the cylindrical sleeve and to be fitted into a gap between the cylindrical sleeve and the reinforcing bars, and which comprises a intermediate pad adapted to be in contact with the reinforcing bars and having an uneven contact surface corresponding to an outer ribbed surface of the reinforcing bars, a gap defined between the cylindrical sleeve and the intermediate pad gradually becoming narrower toward the middle point of the cylindrical sleeve, and two wedge elements adapted to be driven into the gap defined between the cylindrical sleeve and the intermediate pad by impact from a striking tool such as a hammer.

The reinforcing bar coupling according to the present invention can be commonly used in joining two reinforcing bars in new construction, rebuilding and repair work of various concrete structures such as bridges and buildings. The reinforcing bar coupling enables easy and firm coupling of reinforcing bars using only a simple striking tool. Furthermore, since reinforcing bars are coupled to each other without overlapping thereof, excessive consumption of reinforcing bars can be prevented and advantageous cost savings can be achieved. In addition, the reinforcing bar coupling exhibits superior bonding strength compared to a conventional coupling method.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

This invention will be described in further detail by way of example with reference to the accompanying drawings.

Figure 1:
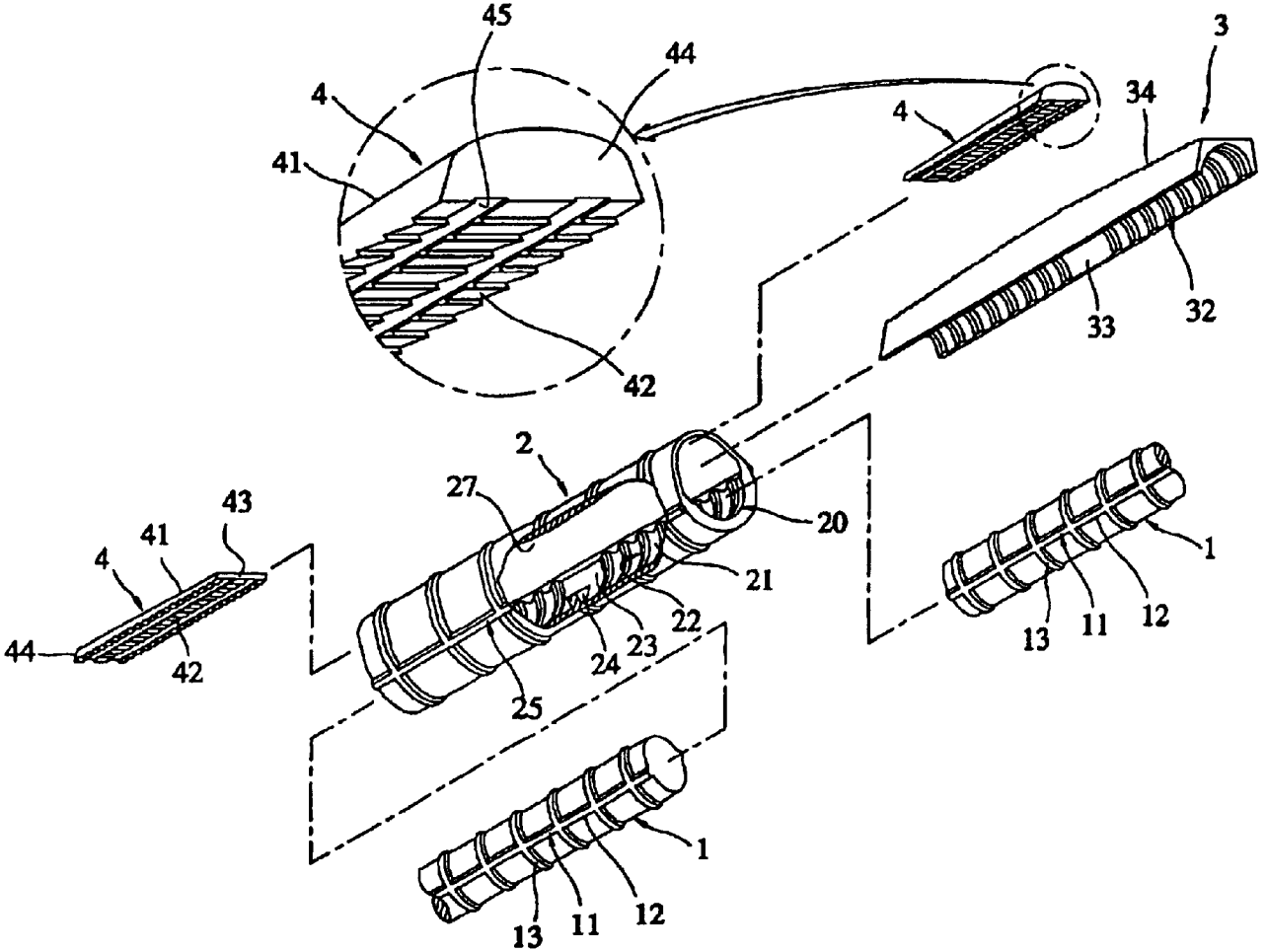
FIG. 1 is an exploded perspective view of a first embodiment of the present invention.
Figure 2:
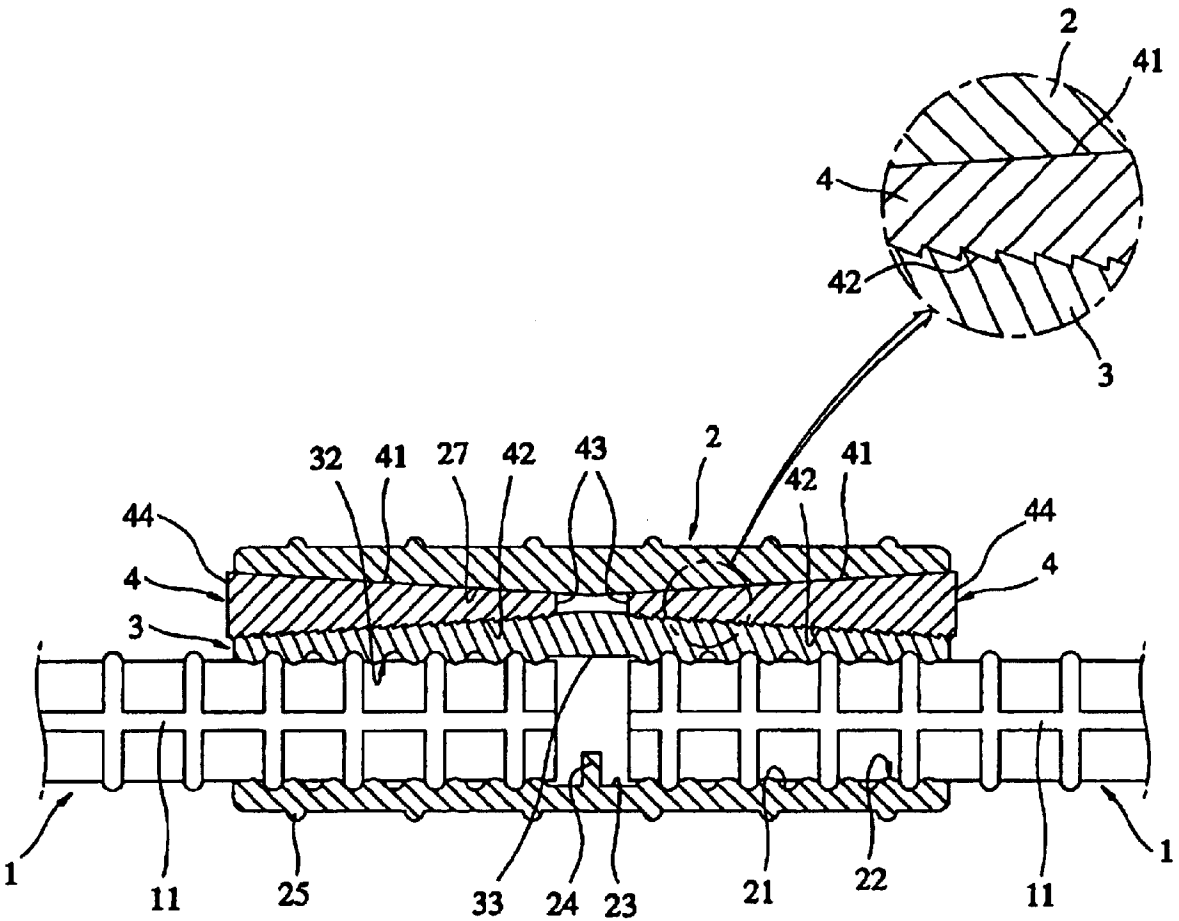
FIG. 2 is a cross-sectional view showing an assembled condition of the first embodiment of the present invention.
Figure 3:
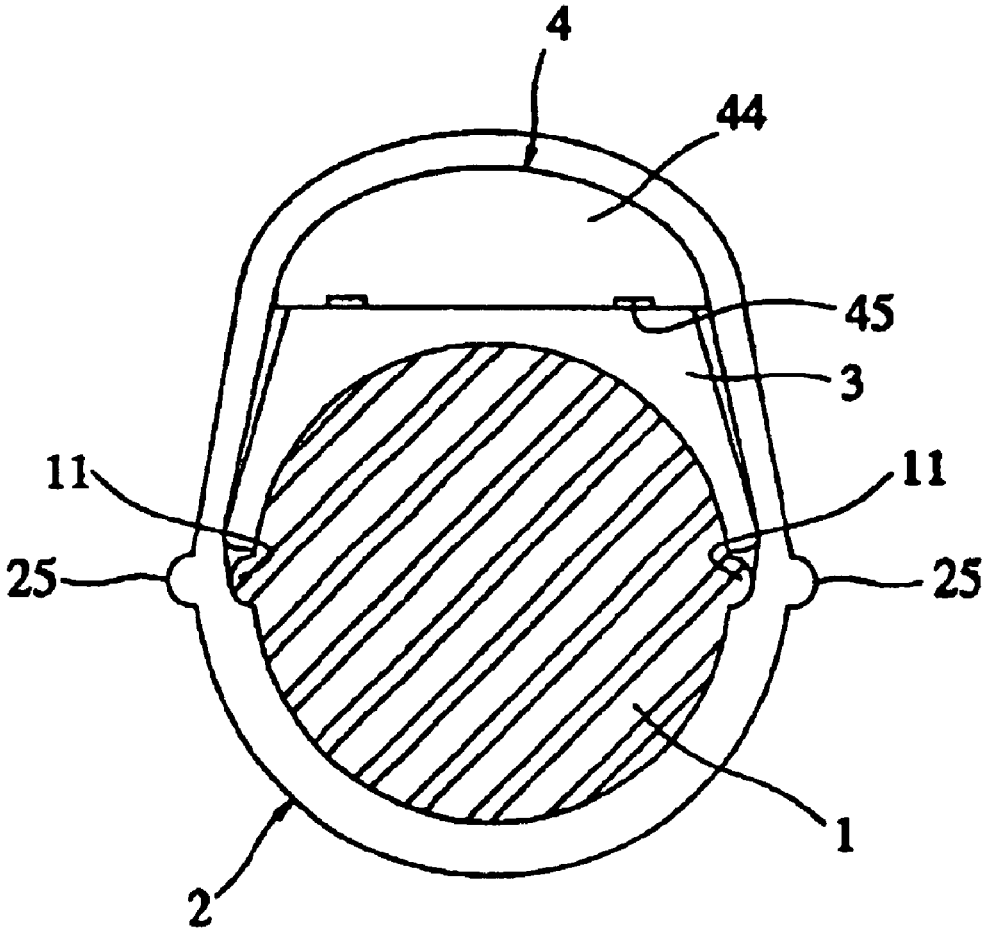
FIG. 3 is a transverse cross-sectional view of the first embodiment of the present invention.
Figure 10:
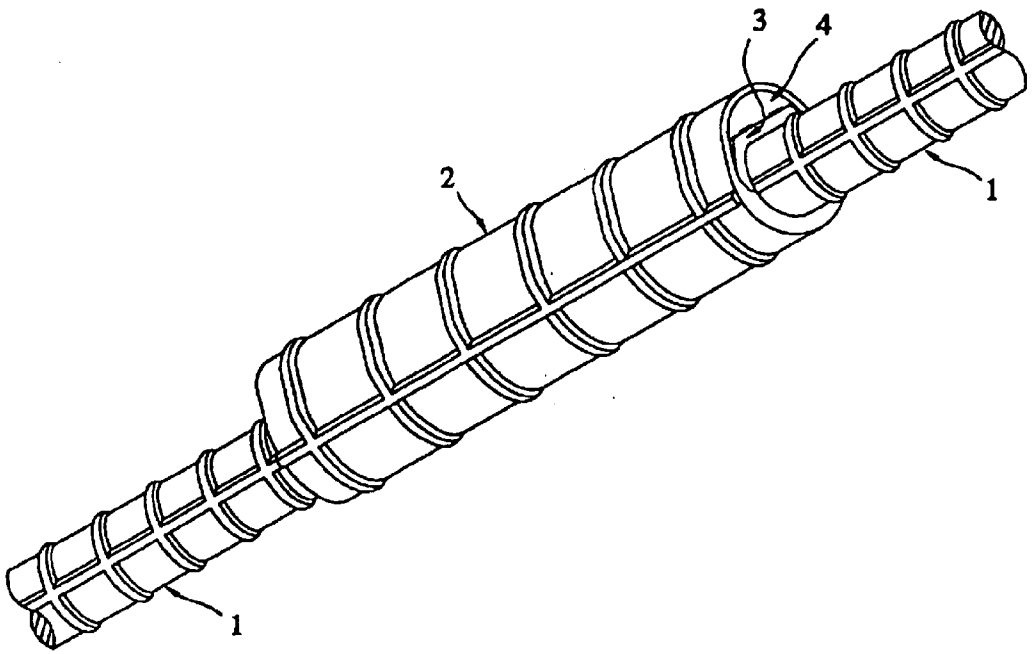
FIG. 10 is a perspective view showing an assembled condition of the first embodiment of the present invention.

FIGS. 1 to 3 are an exploded perspective view, a cross-sectional view and a transverse cross-sectional view of a first embodiment of the present invention, in which the embodiment of the present invention comprises a cylindrical sleeve 2, a intermediate pad 3 and a pair of wedges 4 to join two reinforcing bars 1. A perspective view of a reinforcing bar coupling according to the embodiment of the present invention is shown in FIG. 10, in which the reinforcing bar coupling is assembled.

The reinforcing bars 1, the intermediate pad 3 and wedges 4 are separately inserted or pushed into openings 20 of the cylindrical sleeve 2 of a certain length. The size of the cylindrical sleeve is designed according to the diameter of the reinforcing bars to be joined. To this end, the cross section of the cylindrical sleeve 2 assumes a shape similar to an ellipse.

As is well known in the art, a reinforcing bar is evenly formed at its outer surface with ribs to improve strength and adhesion to the concrete. The cylindrical sleeve 2 is provided with an uneven surface on its inner surface by grooves 21 along the length such that the grooves 21 are formed to have an arrangement corresponding to that of the ribs (or the outer shape) of the reinforcing bars. With the grooves 21 formed on the inner surface of the cylindrical sleeve 2, reinforcing bars cannot be axially displaced once the reinforcing bars are inserted into and engaged to the cylindrical sleeve 2.

The ribs 11 consist of semi-longitudinal ribs 12 and semi-annular ribs 13. In some reinforcing bars, the semi-annular ribs 13 may be alternately formed along the semi-longitudinal ribs 12 (not shown). To accommodate for reinforcing bars having such alternate semi-annular ribs, the semi-annular grooves 21 are arranged such that the patterns of the adjacent semi-annular grooves 21 formed on the uneven surface is one-half of the patterns of adjacent semi-annular ribs 13.

Although not shown, since there may be difficulty to insert reinforcing bars into the cylindrical sleeve such that the reinforcing bars radially coincide with each other, the cylindrical sleeve 2 may be provided with several semi-longitudinal grooves on its uneven surface. If it includes the semi-longitudinal grooves, the uneven surface of the cylindrical sleeve will assume a lattice shape. A contact angle between an outer surface of a reinforcing bar and the uneven surface 22 of the cylindrical sleeve or an inner surface of the intermediate pad may be between 90°–180°, but the contact angle is not necessarily limited to that.

Although a reinforcing bar 1 may be formed with burrs at its cut end or may be uneven in the diameter of its outer surface, the uneven surface 22 of the cylindrical sleeve is adapted to be in close contact with the reinforcing bar. This can be achieved in such a way that an inner diameter of a certain middle section of the cylindrical sleeve (corresponding to a portion at which the ends of reinforcing bars are positioned for joining) is larger than that of the inner surface near the openings 20 at each end of the cylindrical sleeve 2. That is, though burrs or deformed portions of the ends of reinforcing bars are positioned at the enlarged inner surface, close contact between the reinforcing bars 1 and the cylindrical sleeve 2 is not interrupted.

Furthermore, so as to limit the inserted lengths of reinforcing bars 1 into the cylindrical sleeve 2, the cylindrical sleeve is provided with a semicircular stopper 24 at its inner middle portion.

An inner slant face 27 of the cylindrical sleeve which faces the uneven inner surface 22 is gradually reduced in its inner diameter from both end openings toward the middle point in order to intensify driving action of the wedges. Details relating to this will be more specifically described hereinafter.

The cylindrical sleeve 2 is formed with semi-longitudinal and semi-annular ribs 25 on its outer surface, similar to ribs 11 of reinforcing bars 1, to improve cohesiveness with concrete.

The intermediate pad 3 is comprised of a semicircular cylinder having a length corresponding to that of the cylindrical sleeve 2, and includes on its inner surface an uneven surface 32 having a shape and a function similar to those of the uneven surface of the cylindrical sleeve, thereby enabling the other half surfaces of the reinforcing bars to be in close contact therewith. The intermediate pad 3 is gradually thickened toward its middle portion to assume a symmetrical contour tapered outward. An angle of inclination of the outer slant surface of the intermediate pad is set to achieve a desired correlation with the cylindrical sleeve and the wedges. As is the case with the cylindrical sleeve, the intermediate pad 3 is provided with an enlarged surface 33 at its inner middle portion, which is formed to accommodate undesirable burrs etc., of the reinforcing bars.

Moreover, an outer surface of the intermediate pad is symmetrically provided with a serration. The serration serves as a blocking means for preventing the wedges 4 from sliding cut between the intermediate pad 3 and the cylindrical sleeve 2 once the wedges 4 are fitted between the intermediate pad 3 and the cylindrical sleeve 2, as shown in FIG. 2. Functions and configuration of the serration are the same in all of the following embodiments. The serration serves to prevent slippage of the wedges, and the shape of the serration is not limited to that shown in the drawings.

The wedges 4 are rectangular plates, characterized by one end being thinner than the other end. A pair of wedges 4 is fitted into the openings 20 of the opposite ends of the cylindrical sleeve. Each of the wedges 4 is configured such that its upper surface 41 conforms to the inner slant face 27 of the cylindrical sleeve 2 and its lower surface conforms to the outer surface 34 of the intermediate pad 3. In addition, the lower surface 42 of the wedge is provided with a serration corresponding to the serration of the outer surface 34 of the intermediate pad 3.

As is well known, the wedge has a shape and a function similar to those of a commonly used wedge. A rear end 44 of the wedge is more enlarged than a front end 43, and serves to be hit with a striking tool such as a hammer.

The overall length of the wedge 4 is slightly shorter than one half of the overall length of the cylindrical sleeve 2. The wedge may be optionally provided with one or more semi-longitudinal grooves 45 without the serration to reduce frictional resistance from the intermediate pad 3 during its insertion. The semi-longitudinal grooves 45 may be provided on one surface or on both surfaces. Such semi-longitudinal grooves may also be formed on the intermediate pad or the cylindrical sleeve.

Functions of the first embodiment of the present invention will be described in order of the assembling procedure.

First, two reinforcing bars to be joined are inserted into the cylindrical sleeve 2 through both ends of the cylindrical sleeve such that the ribs 11 of the reinforcing bars 1 are in close contact with the uneven surface 22 of the cylindrical sleeve 2 and the ends of the reinforcing bars are positioned at the enlarged portion. Subsequently, the intermediate pad 3 is fully inserted into the cylindrical sleeve 2 so that the intermediate pad comes into close contact with the ribs 11 of the reinforcing bars. After two wedges 4 are temporarily fitted between the intermediate 3 and the cylindrical sleeve 2 though both ends of the cylindrical sleeve 2, the wedges are strongly impacted with a striking tool such as a hammer.

By the impact of the hammer, the inner slant face 27 of the cylindrical sleeve 2 and the outer surface of the reinforcing bars 1 are applied with strong radial pressure via the intermediate pad 3. That is, a firmly engaged condition of the components is achieved by action of the wedges. Furthermore, since the wedges and the intermediate pad are engaged with each other by the serration formed on the surfaces of both components, the wedges cannot slide out of the cylindrical sleeve even if the cylindrical sleeve is subjected to vibration or external force. Moreover, even though strong external tensile force acts on the cylindrical sleeve, the engaged condition of the reinforcing bars is not broken by the uneven surfaces 22, 32 of the cylindrical sleeve and the intermediate pad engaged with the ribs 11 of the reinforcing bars.

Figure 4:
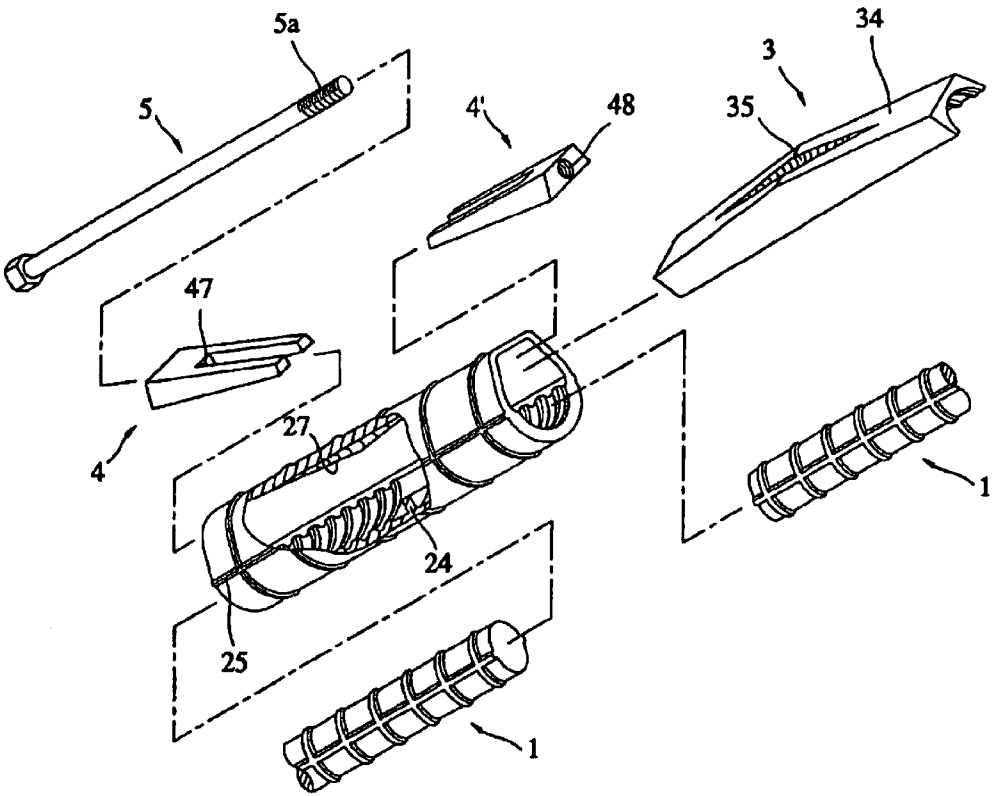
FIG. 4 is an exploded perspective view of a second embodiment of the present invention.
Figure 5:
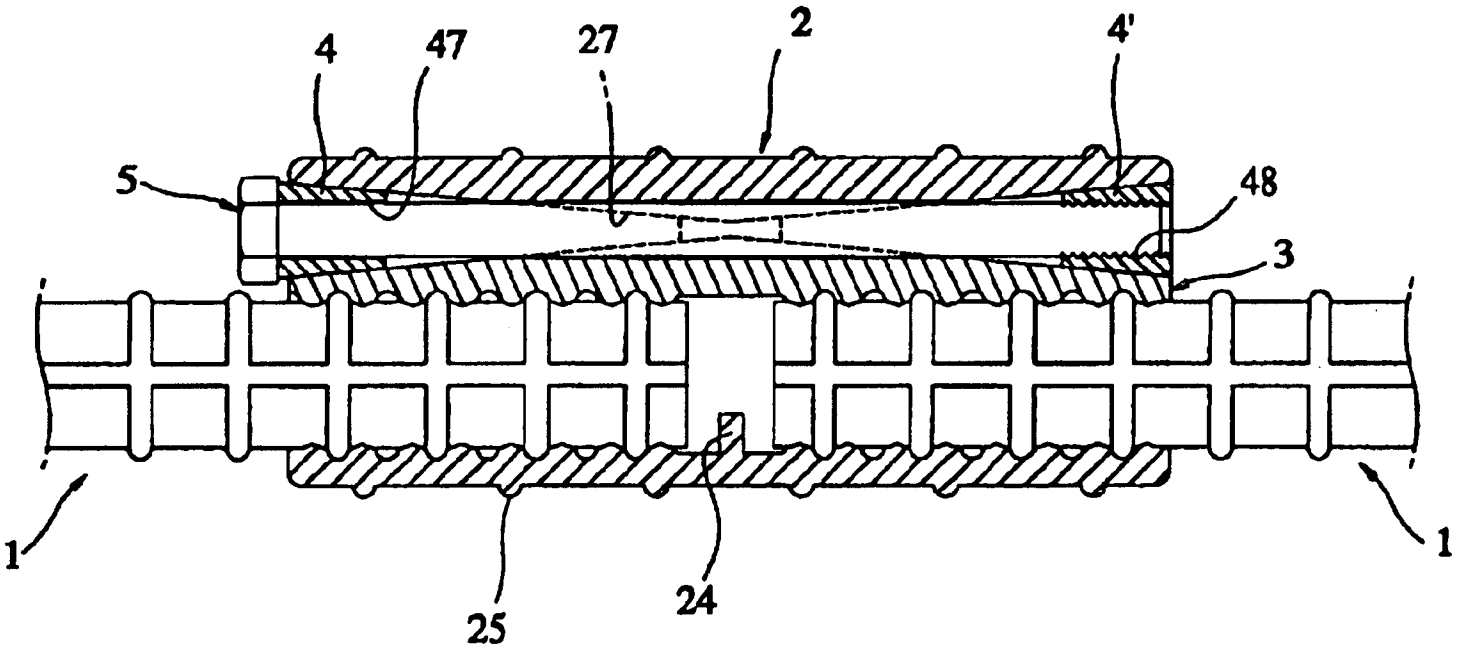
FIG. 5 is a cross-sectional view showing an assembled condition of the second embodiment of the present invention.
Figure 6:
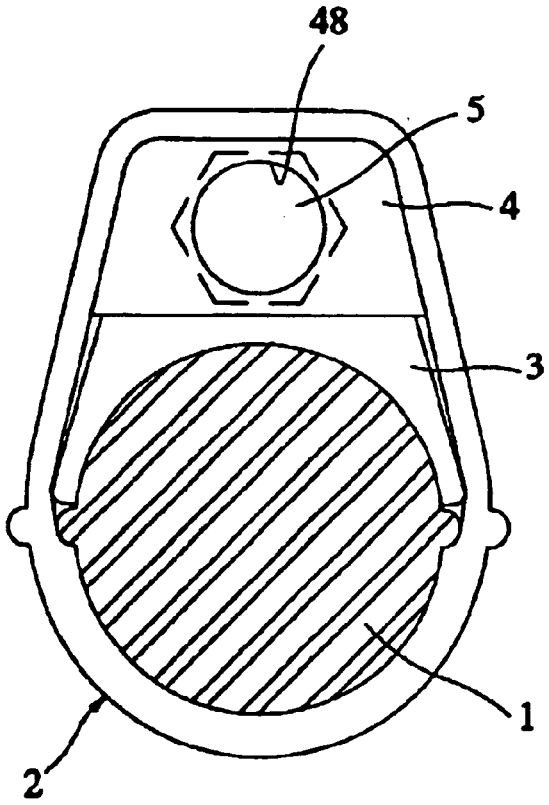
FIG. 6 is a transverse cross-sectional view of the second embodiment of the present invention.

FIGS. 4 to 6 show a second embodiment of the present invention. The essential configuration of the second embodiment is substantially equal to that of the first embodiment, except that wedges 4, 4' are driven into the cylindrical sleeve by a bolt 5 rather than the impact of a hammer. That is, one wedge 4 of a paired wedges is formed with a longitudinal through hole 47, and the other wedge 4' of the paired wedges is formed with a threaded hole 48, which is adapted to be engaged with a male threaded portion 5*a* of the bolt 5.

The bolt 5 has a diameter suitable to the size of reinforcing bars 1 to be joined. To induce the longitudinal cross sectional area, each of the wedges 4, 4' is shaped as a "U"-shaped clamp in plan, as illustrated in FIG. 4. The intermediate pad 3 is provided at its outer slant surface with a semi-longitudinal groove 35 to allow the bolt 5 to pass through. Therefore, the cylindrical sleeve 2 can be reduced in its cross sectional area. In an arrangement of a plurality of reinforcing bars, it is generally known that it is preferable to reduce the cross section of the cylindrical sleeve in terms of a building operation and strength of a beam.

A modification which can be derived from this embodiment is configured such that the bolt 5 is longitudinally elongated to fully pass through a wedge 4' with its male threaded end 5*a* protruding from the wedge and the threaded end of the bolt is screwed into a nut (not shown). In this case, a seat face and/or seat faces of the bolt and/or the nut can be of course provided with a common washer.

As described above, functions of the second embodiment of the present invention are substantially equal to those of the first embodiment of the present invention. However, this embodiment is different from the first embodiment only in that the wedges 4 are driven into the cylindrical sleeve by fastening action of the bolt 5 between the female threaded hole 48 of the wedge 4' or a nut (not shown) rather than by impact of a hammer.

Another modification which can be derived from this embodiment is designed to employ a combined action of the impact of a hammer and fastening of a bolt and a nut. In other words the wedges 4 are first driven into a cylindrical sleeve by hitting of a hammer and then fastened by the bolt 5. Since this modification can be fulfilled by designing to adjust angles of inclination of the wedges and the intermediate pad, detailed description thereof is omitted.

The method of coupling reinforcing bars according to the second embodiment of the present invention can be advantageously applied to an operation of coupling new reinforcing bars to existing reinforcing bars 1 which have been previously arranged, or to existing reinforcing bars 1 which are embedded in poured concrete where adhesive force between the existing reinforcing bars and the concrete may be weakened by impact shocks acting on the wedges.

The stopper 24, the ribs 25 and the inner slant face 27 of this embodiment have the same shapes and functions as those of the first embodiment.

Figure 7:
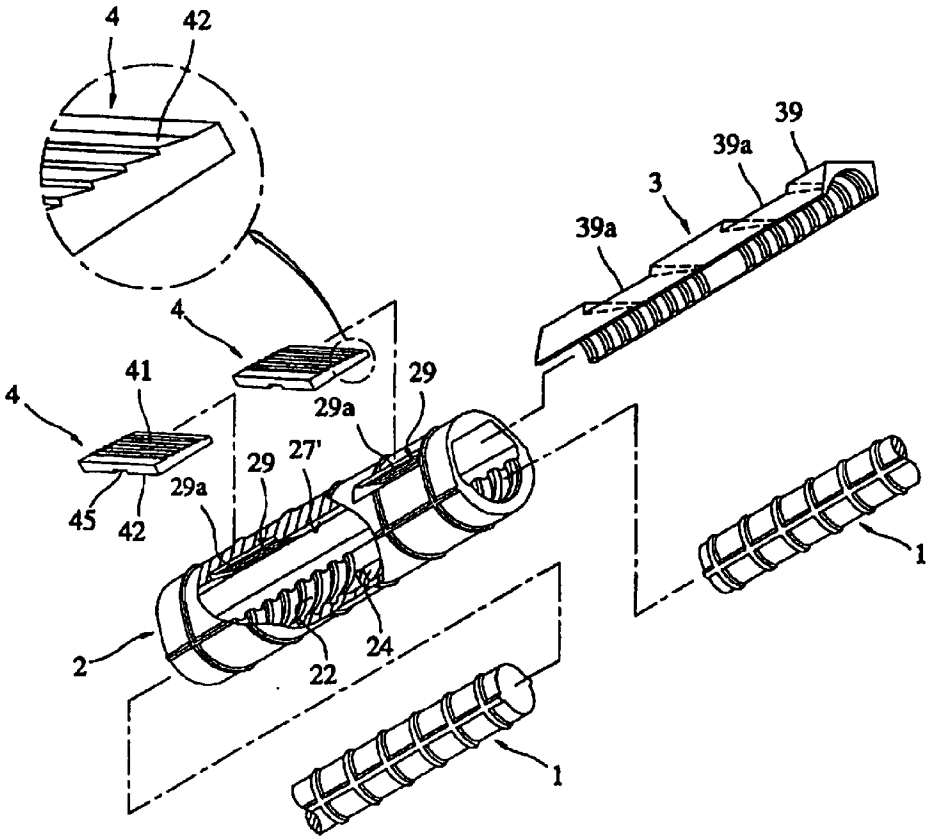
FIG. 7 is an exploded perspective view of a third embodiment of the present invention.
Figure 8:
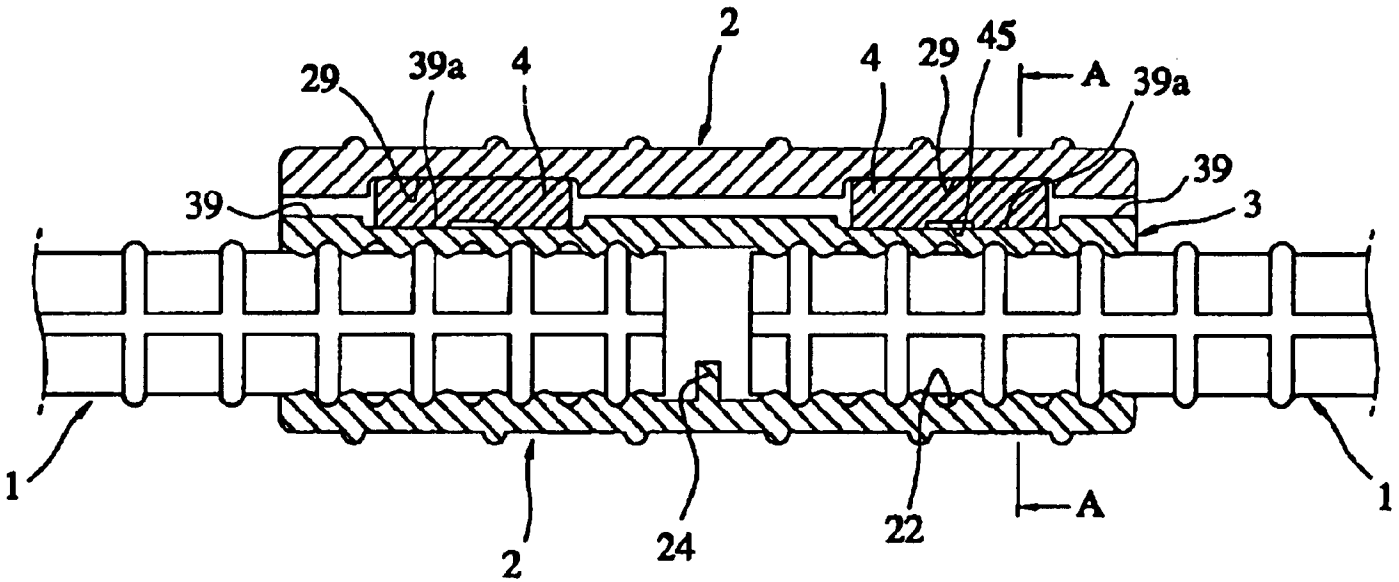
FIG. 8 is a cross-sectional view showing an assembled condition of the third embodiment of the present invention.
Figure 9:
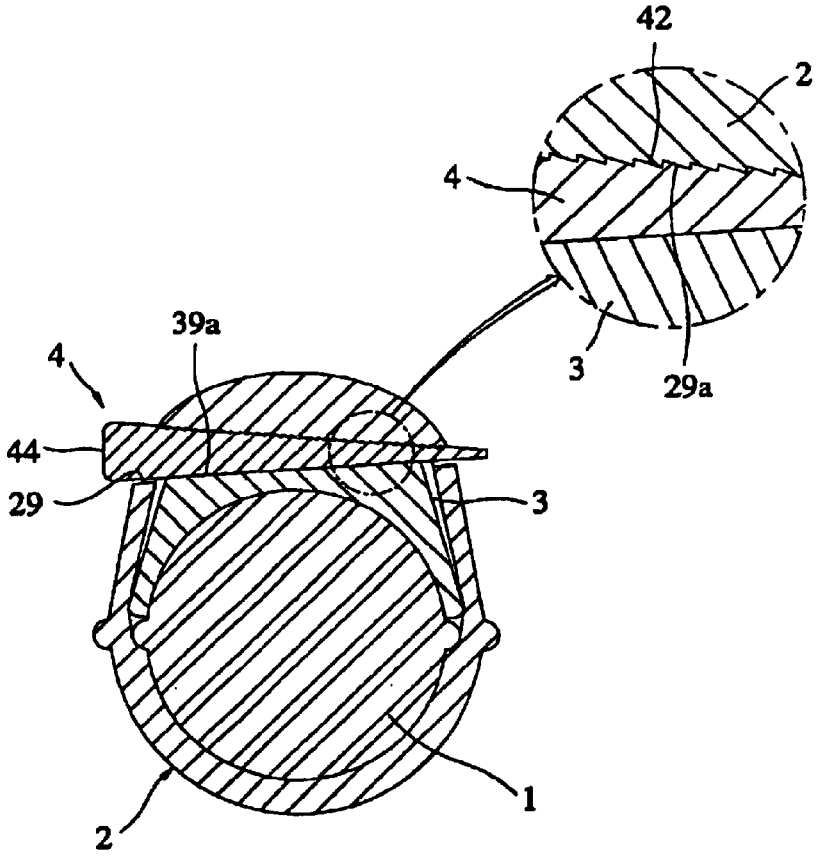
FIG. 9 is a cross-sectional view taken along line A—A of FIG. 8.

FIGS. 7 to 9 show a third embodiment of the present invention. The essential configuration of this third embodiment is substantially equal to that of the first and second embodiments, except that the driving direction of the wedges 4 is perpendicular or transverse to the reinforcing bars. To this end, a cylindrical sleeve 2 is formed with two wedge fitting openings 29, which are oriented to be perpendicular or transverse to the reinforcing bars. Furthermore, a intermediate pad 3 is formed at its upper surface 39 with two wedge seat grooves 39*a*, which are located at positions corresponding to those of the wedge fitting openings 29, and each of which has a width equal to or larger than a width of the wedge 4.

As shown in FIG. 9, upper surfaces 41 of the wedges 4 and upper surfaces 29*a* of the wedge fitting openings 29 of the cylindrical sleeve 2 have serrated surfaces corresponding to each other. The serration serves to prevent the wedges from sliding out of the cylindrical sleeve.

The fitting manner and other details of this embodiment are substantially identical to those of the previous embodiments. That is, the stopper 24 and the uneven surface etc., of the cylindrical sleeve 2 are identical to those of the previous embodiments in function and shapes.

The characteristics of this embodiment are as follows. Widths of the wedge fitting openings 29 of the cylindrical sleeve 2 and widths of the wedge seat grooves 39*a* of the intermediate pad 3 are set to be slightly larger than a width of the wedge 4. Accordingly, even though axial positions of semi-annular ribs 13 of a reinforcing bar are alternately arranged along semi-longitudinal ribs 12 or irregularly arranged so that the wedge fitting openings 29 of the cylindrical sleeve 2 are not aligned with the wedge seat faces 39*a* of the intermediate pad 3, the wedges 4 can be easily fitted into the cylindrical sleeve. In addition, corners of the wedge fitting openings 29 are rounded to prevent the possibility of cracking of the cylindrical sleeve 2 during installation of the wedges.

A groove 45 is provided to reduce resistance during a fitting operation of the wedges, and a rear end 44 to be hit by a striking tool of a user.

A modification which can be derived from this embodiment of the present invention is configured such that the two wedges are integrally formed. In this modification, since the fitting direction of the two wedges are identical to each other and the fitting positions of the wedges are adjacent to each other, the two wedges are integrally connected to each other to form a U-shaped clamp to permit the two wedges to be fitted concurrently.

Figure 11:
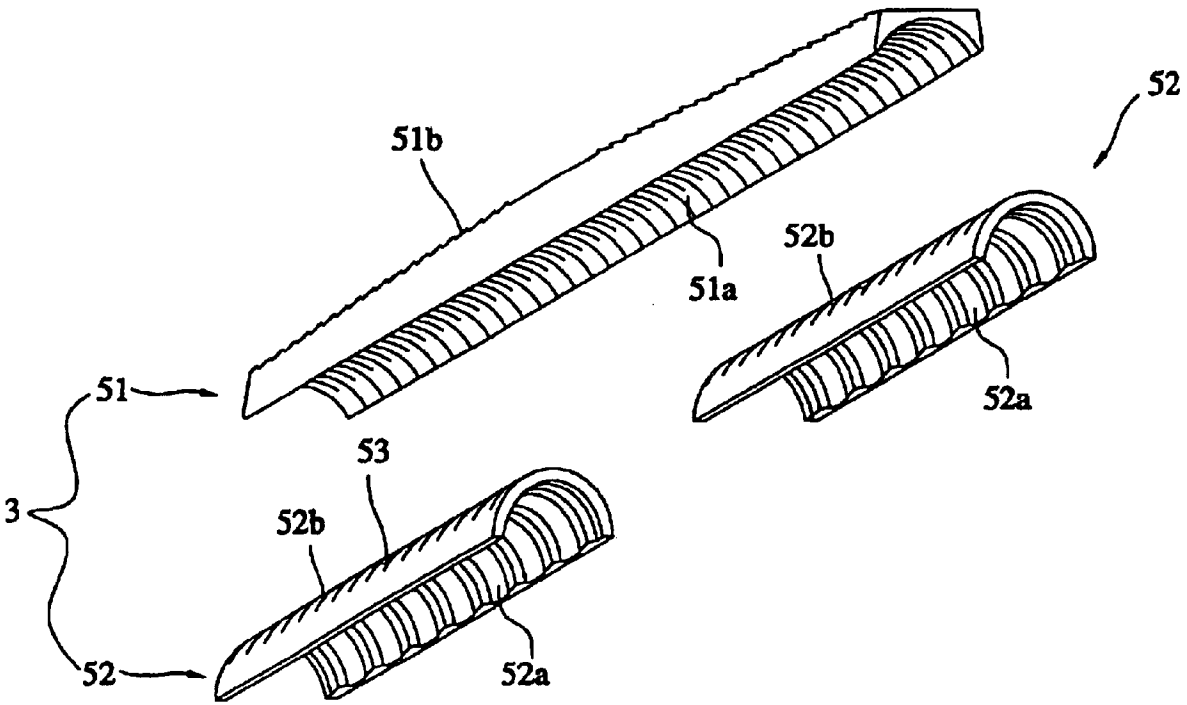
FIG. 11 is an exploded perspective view of an intermediate pad according to a fourth embodiment of the present invention.
Figure 12:
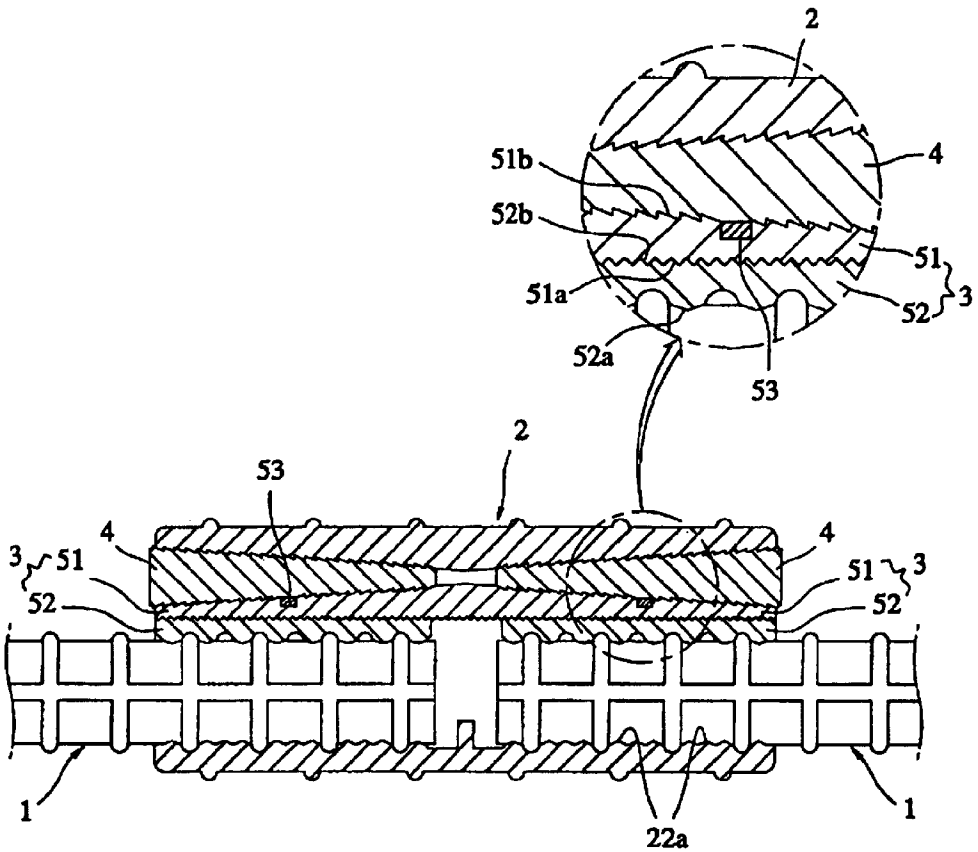
FIG. 12 is a cross-sectional view of a reinforcing bar coupling to which the intermediate pad of FIG. 11 is applied.
Figure 13:
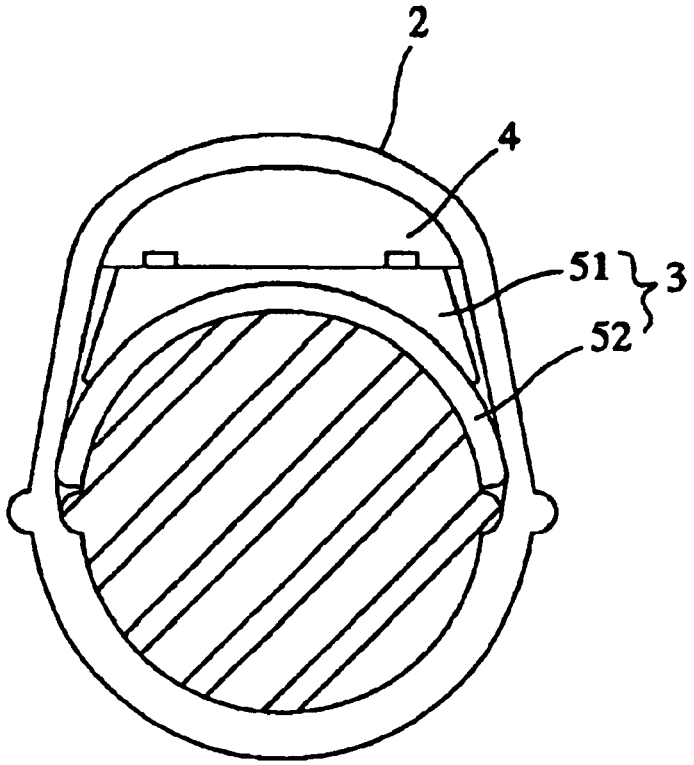
FIG. 13 is a transverse cross-sectional view of a reinforcing bar coupling to which the intermediate pad of FIG. 11 is applied.

Referring to FIGS. 11 to 13, there is shown a fourth embodiment of the present invention. This embodiment is designed to be applied in the case where shapes and positions of semi-annular ribs formed on the outer surfaces of the reinforcing bars provided by various manufacturers are different from one another. That is, where grooves of an uneven surface of an intermediate pad do not coincide with semi-annular ribs of a reinforcing bar in position, the area of the contact surface between the intermediate pad and the reinforcing bar is reduced. To accommodate such nonconformity between the grooves of the intermediate pad and the semi-annular ribs of the reinforcing bars, this embodiment is intended to allow the intermediate pad to be slightly displaced to conform to the reinforcing bar.

To this end, the intermediate pad 3 comprises three intermediate sub pads, as shown in FIG. 11. In other words, the intermediate pad 3 comprises a first intermediate pad 51 and a pair of second intermediate pads 52. The second intermediate pads 52*a* are provided with uneven surfaces on the lower surfaces thereof, corresponding to an outer surface of a reinforcing bar. The facing surfaces 51*a*, 52*b* of the first and second intermediate pads are provided with serrations in the form of triangular screw threads so that the first and second intermediate pads are engaged with each other by the serration surfaces 51*a*, 52*b*. Prior to assembly of the cylindrical sleeve joint, the second intermediate pads can be held in place against the first intermediate pad by means of magnets mounted on the second intermediate pads. As such, since the second intermediate pads are provided with magnets, the number of components required to joint reinforcing bars can be reduced, thereby facilitating maintenance and the joining operation of the coupling.

An upper surface 51*b* of the first intermediate pad is provided with a serrated surface for preventing sliding of the wedges 4, as is the case with the previous embodiments.

FIGS. 12 and 13 are a cross-sectional view and a transverse cross-sectional view showing the intermediate pads used in joining reinforcing bars.

Two reinforcing bars are first inserted into the cylindrical sleeve, followed by the first and second intermediate pads. Then, the second intermediate pads are adjusted in their longitudinal positions to conform to outer surfaces of the reinforcing bars. Thereafter, the wedges 4 are driven into the cylindrical sleeve by a striking action of a hammer to complete a coupling operation of the reinforcing bars.

In this embodiment, although two pieces of the second intermediate pads are shown in FIGS. 11 and 12 disposed at both sides of the cylindrical sleeve, one piece second intermediate pad may be disposed in the cylindrical sleeve. That is, one-piece second intermediate pad may be disposed under the first intermediate pad.

According to the embodiment shown in FIG. 12, each of the wedges is provided with serrated surfaces at both its upper and lower surfaces, and the cylindrical sleeve is also provided with a serrated surface at its upper surface. As such, the serrated surfaces may be selectively formed at either one or both of the upper and lower surfaces of the wedge.

The cylindrical sleeve 2, which directly comes into contact with a reinforcing bar, is provided at its lower surface with ridges 22*a* in the form of screw threads in order to intensify compressing action to the reinforcing bars due to the driving of the wedges. The ridges can be applied to all the previous embodiments as well as this embodiment.

In still another embodiment of the present invention, reinforcing bars can be joined using only the cylindrical sleeve and the wedges without the intermediate pad. Those skilled in the art will appreciate that this embodiment can be derived from the basic idea of the present invention with reference to the above embodiment.

The components of the reinforcing bar coupling are preferably made from material having strength equal to or higher than that of the reinforcing bars to be joined, to sufficiently resist tensile force or compression force acting on a ferroconcrete building incorporating the coupling. Any one of cast steel, steel, stainless steel, soft iron and synthetic resin can be selected as a material in consideration of service condition, production cost and so on.

As such, the reinforcing bar coupling according to the present invention is capable of joining reinforcing bars in various ways. Those skilled in the art will appreciate that various modifications, additions and substitutions are possible with reference to the above embodiments without departing from the scope and spirit of the invention.

As described above, though a reinforcing bar coupling according to the present invention is mainly used in such a way that wedges are driven into a cylindrical sleeve by the striking action of a hammer, the wedges may be fastened by bolts using a fastening tool such as a spanner if required. Therefore, a coupling operation of reinforcing bars is facilitated. Furthermore, site work becomes convenient owing to reduction of the number of components, and wedges cannot slide out of a cylindrical sleeve, due to engagement between serrated surfaces of the wedges and a cylindrical sleeve. The disclosed reinforcing bar coupling can be used in joining two reinforcing bars in new construction, rebuilding and repair work of various concrete structures, such as bridges and buildings.

What is claimed is:

1. A reinforcing bar coupling, comprising:

a cylindrical sleeve (2) having a cross sectional area sufficient to accommodate two reinforcing bars (1) inserted through end openings, one-half of an inside of said cylindrical sleeve (2) having a semi-circular uneven inner surface having patterns similar to an outer ribbed surface of said reinforcing bars (1), the patterns intended to directly contact each other, and an opposite half of the inside of said cylindrical sleeve (2) having a varying cross sectional area along its length, an intermediate pad (3) having a semi-circular uneven inner-surface on one-side for mating with said reinforcing bars (1), and a narrow flat surface on an opposite-side, thereby providing a gap between said cylindrical sleeve (2) and said intermediate pad (3) such that the gap varies along its length, and a wedge element (4) inserted into said gap through the end openings, wherein at least one side of said wedge element (4) is tapered for frictional contact with said intermediate pad (3) and said cylindrical sleeve (2).

2. The reinforcing bar coupling as set forth in claim 1, wherein one-half of the inside of said cylindrical sleeve (2) forms a tapered semi-circular inner surface whose cross sectional area gradually decreases from the end openings toward a center portion.

3. The reinforcing bar coupling as set forth in claim 2, wherein said cylindrical sleeve (2) is provided with a stopper (24) at an inner center portion for limiting an insertion depth of said reinforcing bars (1).

4. The reinforcing bar coupling as set forth in claim 2, wherein said cylindrical sleeve (2) is provided with a space at an inner center portion for accommodating protrusions, such as burrs, which may be present at the ends of the reinforcing bars (1).

5. The reinforcing bar coupling as set forth in claim 2, wherein the outer surface of said cylindrical sleeve (2) forms a plurality of semi-annular ribs and semi-longitudinal ribs similar to ribs disposed on the outer surface of said reinforcing bars (1) to improve adhesion to concrete.

6. The reinforcing bar coupling as set forth in claim 2, wherein one element of a pair of wedge elements (4) forms a longitudinal hole for inserting there through a shank of a bolt, and an opposite element of the pair of wedge elements (4) forms a threaded hole for engaging the bolt, and said paired wedge elements (4) are inserted into a gap between said cylindrical sleeve (2) and said intermediate pad (3) for clamping each other to produce wedge action.

7. The reinforcing bar coupling as set forth in claim 2, wherein said intermediate pad (3) comprises a first intermediate pad (51) and a pair of second intermediate pads (52), inner surfaces of said second intermediate pads (52) are provided with semi-circular uneven surfaces (52*a*) corresponding to the outer surface pattern of the reinforcing bars (1), outer surfaces (53) of said second intermediate pads (52) have serrations (52*b*) for engaging with opposed serrations (51*a*) of said first intermediate pad (51) for adjusting position of said second intermediate pads (52) with respect to various rib patterns of said reinforcing bars (1).

8. The reinforcing bar coupling as set forth in claim 2, wherein said cylindrical sleeve (2) includes a plurality of ridges and grooves with the same patterns of semi-annular ribs and semi-longitudinal ribs of said reinforcing bars (1) for evenly contacting and pressing against the outer surface of said reinforcing bars (1).

9. The reinforcing bar coupling as set forth in claim 1, wherein on at least one side of the wedge element (4), serrations are provided to engage with opposed serrations provided on said intermediate pad (3) or inner surface of said cylindrical sleeve (2).

10. The reinforcing bar coupling as set forth in claim 9, wherein more than one groove is provided on said wedge element to reduce frictional resistance for tight fitting.

11. The reinforcing bar coupling as set forth in claim 1, wherein said cylindrical sleeve (2) forms a pair of side openings for inserting the wedge elements (4) in a direction transverse to the reinforcing bars (1) and a pair of cut-off pockets for mounting said wedge elements (4), said intermediate pad (3) further includes a pair of cut-off flat saddles for mounting the wedge elements (4), thereby forming a pair of pockets between said cylindrical sleeve (2) and said intermediate pad (3), and said pair of wedge elements (4) include serrations that are configured with a width longer than the width of said cylindrical sleeve (2) to fit into the pockets between said cylindrical sleeve (2) and said intermediate pad (3) for clamping by wedging action.

12. The reinforcing bar coupling as set forth in claim 11, wherein said wedge elements (4) are connected to each other through outer heads to form a U-shaped clamp.

* * * * *